US005862693A

United States Patent [19]

Myers et al.

[11] Patent Number: 5,862,693

[45] Date of Patent: Jan. 26, 1999

[54] ELECTRONICALLY CONTROLLED SECURITY LOCK

[75] Inventors: Gary L. Myers, Monee; Calin V. Roatis, Des Plaines; Paul D. Caplinger, Tinley Park, all of Ill.

[73] Assignee: Fort Lock Corporation, River Grove, Ill.

[21] Appl. No.: 850,918

[22] Filed: May 2, 1997

[51] Int. Cl.[6] ..... E05B 47/04

[52] U.S. Cl. ..... 70/278; 70/282; 292/144; 292/150

[58] Field of Search ..... 70/279–283, 277, 70/278; 292/144, 150, 169.13, 169.14, 346

[56] References Cited

U.S. PATENT DOCUMENTS

| | | | |
|---|---|---|---|
| 1,952,393 | 3/1934 | Tigue | 292/144 X |
| 3,073,143 | 1/1963 | Eads | 292/169.14 X |
| 3,792,391 | 2/1974 | Ewing | 292/144 X |
| 3,953,991 | 5/1976 | Grossman | 70/279 X |
| 4,277,094 | 7/1981 | Roue | 292/144 X |
| 4,671,089 | 6/1987 | Fleming et al. | 70/422 X |
| 4,691,542 | 9/1987 | Young | 292/144 X |
| 4,772,055 | 9/1988 | Fang | 292/337 |
| 4,848,118 | 7/1989 | Tesone | 292/169.17 X |
| 4,922,817 | 5/1990 | Holodnak | 292/144 X |
| 5,100,184 | 3/1992 | Schmitt | 292/144 |
| 5,531,086 | 7/1996 | Bryant | 292/144 X |
| 5,636,880 | 6/1997 | Miller et al. | 292/144 |

FOREIGN PATENT DOCUMENTS

| | | | |
|---|---|---|---|
| 2533612 | 3/1984 | France | 292/144 |
| 159279 | 6/1957 | Sweden | 292/144 |

*Primary Examiner*—Lloyd A. Gall
*Attorney, Agent, or Firm*—Banner & Witcoff Ltd

[57] ABSTRACT

An electronically controlled security lock is provided for use with safes, vaults, hotel rooms, safe deposit boxes, and the like. The security lock includes a housing having an interior region, exterior surfaces, and an aperture therethrough with a pair of opposed channels. The security lock also includes a dead bolt which is slidably disposed within the aperture of the housing, an actuator with a movable plunger element such as an electromagnetic solenoid which is arranged within the interior region of the housing, and a linkage which connects the plunger element and the dead bolt. The linkage of the security lock includes a pin which is received by openings formed in the dead bolt and by the channels of the aperture. In operation, the plunger element of the actuator moves the linkage and the dead bolt when an electric current is passed through the actuator. More specifically, the dead bolt moves between a retracted position wherein the dead bolt is substantially withdrawn within the housing and an extended position wherein the dead bolt protrudes at least partially outwardly away from the housing. When the dead bolt is in the extended position, the pin of the linkage engages stops formed within the channels of the aperture and latches the dead bolt in the extended position. A spring is also provided between the actuator and the linkage for biasing the dead bolt towards the extended position.

20 Claims, 3 Drawing Sheets

FIG.1
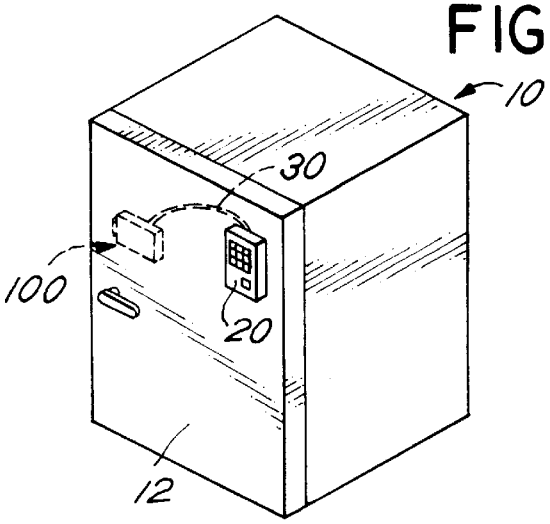
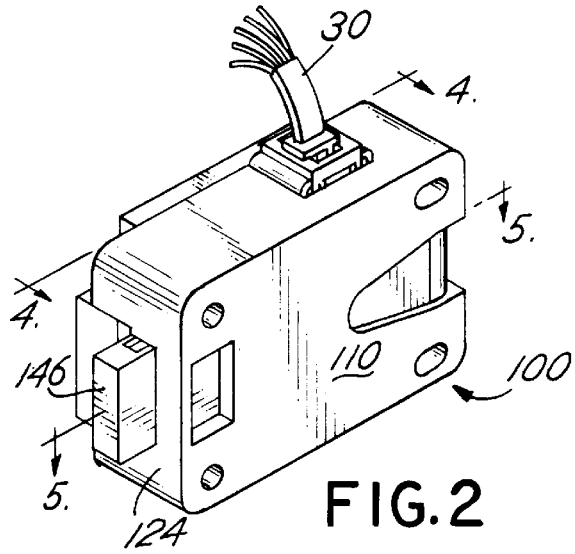
FIG.2
FIG.3
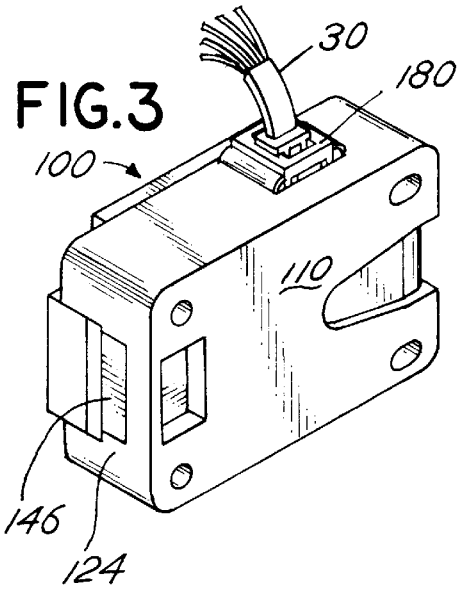
FIG.4
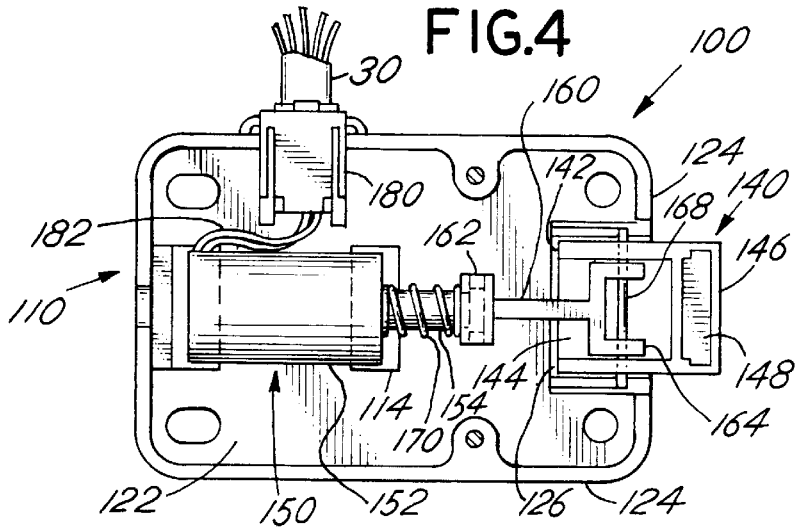

ELECTRONICALLY CONTROLLED SECURITY LOCK

FIELD OF THE INVENTION

The present invention relates generally to locking devices and, more particularly, to an electronically controlled security lock for use with safes, vaults, hotel rooms, safe deposit boxes, and the like.

BACKGROUND OF THE INVENTION

Many different types of electronically controlled security locks for safes and the like are known in the art. Examples of such "lock boxes" are disclosed, for example, in U.S. Pat. Nos. 4,926,664, 5,020,345, and 5,033,282. The simplest and most practical type of lock box utilizes a dead bolt which is biased into an extended or locking position by a spring and is withdrawn into a retracted or unlocking position by an electromagnetic solenoid. Such locks, however, suffer from certain deficiencies which may permit a person familiar with their construction and manner of functioning to pick or otherwise defeat the lock. For example, such locks may be defeated by applying an external prying force to the dead bolt in a way which overcomes the biasing of the spring. Such locks may also be defeated by applying an external jarring force to the lock by dropping the safe where the lock is incorporated, by exerting a heavy blow in a direction opposite to the movement of the dead bolt, or by jolting the lock in some other manner which overcomes the biasing of the spring.

More complex types of electronically controlled security locks are disclosed in U.S. Pat. Nos. 4,745,784, 4,904,984, and 5,249,831. Such locks include rather complex mechanical or auxiliary latching arrangements disposed within the lock box for retaining the dead bolt in the extended position. Such latching arrangements, however, are not only costly to manufacture, but difficult to assemble and prone to malfunction.

OBJECTS OF THE INVENTION

Accordingly, a general object of the present invention is to provide an electronically controlled security lock which overcomes the deficiencies of the prior art with a simple, low cost design and a minimal number of parts.

Another object of the present invention is to provide an electronically controlled security lock which is tamper and pick resistant.

A further object of the present invention is to provide an electronically controlled security lock which is operable by entering a numeric access code.

Still another object of the present invention is to provide an electronically controlled security lock having the foregoing features which is reliable, durable, and convenient to use.

These and other objects, features, and advantages of the present invention will become apparent upon reading the following detailed description of a preferred exemplified embodiment and upon reference to the accompanying drawings.

SUMMARY OF THE INVENTION

Accordingly, an electronically controlled security lock is provided for accomplishing these objects and for overcoming the above-identified drawbacks of the prior art. In particular, the inventive security lock includes a housing having an interior region, exterior surfaces, and an aperture therethrough with a pair of opposed channels. The security lock also includes a dead bolt slidably disposed within the aperture of the housing, an actuator with a movable plunger element such as an electromagnetic solenoid arranged within the interior region of the housing, and a linkage connecting the plunger element and the dead bolt. The linkage of the inventive security lock includes a pin which is received by openings formed in the dead bolt and by the channels of the aperture. In operation, the plunger element of the actuator moves the linkage and the dead bolt when an electric current is passed through the actuator. More specifically, the dead bolt moves between a retracted position wherein the dead bolt is substantially withdrawn within the housing and an extended position wherein the dead bolt protrudes at least partially outwardly away from the housing. When the dead bolt is in the extended position, the pin of the linkage engages stops formed within the channels of the aperture and latches the dead bolt in the extended position. A spring is also provided between the actuator and the linkage for biasing the dead bolt towards the extended position.

BRIEF DESCRIPTION OF THE DRAWINGS

In the drawings, wherein similar reference numerals denote similar elements throughout the several views:

FIG. 1 is a environmental perspective view of a safe utilizing an electronically controlled security lock constructed in accordance with the present invention;

FIG. 2 is a perspective view of the electronically controlled security lock depicted in FIG. 1, showing a dead bolt for the lock in an extended position;

FIG. 3 is a perspective view of the electronically controlled security lock depicted in FIG. 2 with the dead bolt in a retracted position;

FIG. 4 is a cross-sectional view of the electronically controlled security lock taken along line 4—4 in FIG. 2, showing an electromagnetic actuator disposed within the interior region of the lock and a linkage which connects a plunger element of the actuator to the dead bolt;

Figure 5:
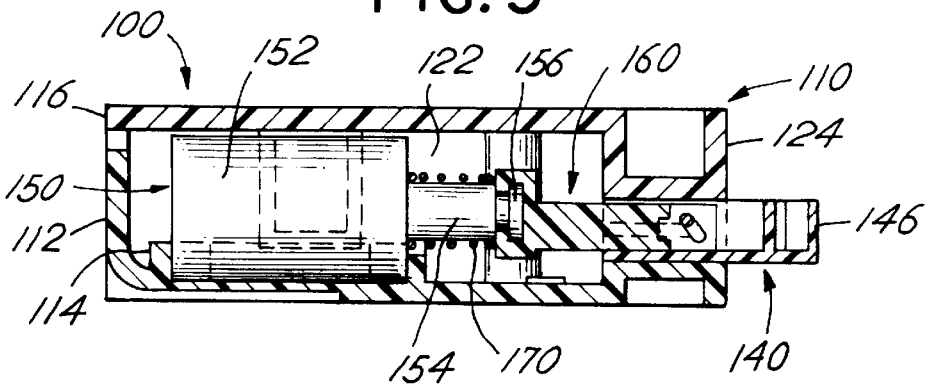
FIG. 5 is a cross-sectional view of the electronically controlled security lock taken along line 5—5 in FIG. 2.

While the present invention will be described and disclosed in connection with certain preferred embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Turning now to the drawings, an electronically controlled security lock constructed in accordance with the present invention is generally designated by reference numeral 100. As shown in FIG. 1, the inventive security lock 100 is intended to protect a security region—such as a safe, a vault, a safe deposit box, a hotel room, a storage room, or the like—from unauthorized access. In the illustrated embodiment, the security lock 100 is shown mounted to the door 12 of a safe 10. More specifically, the security lock 100 is attached to the interior surface of the safe door 12, an electronic input panel or keyboard 20 for entering a numeric access code for the lock 100 is attached to the exterior surface of the safe door 12, and a modular connector 30 is used to interconnect the lock 100 and access panel 20. Although the inventive security lock 100 is shown mounted to the door 12 of a safe 10 in a specific manner, it will be readily appreciated by those skilled in the art that the lock 100 may alternatively be mounted to other structures and in other manners without departing from the scope or spirit of the present invention.

Figure 9:
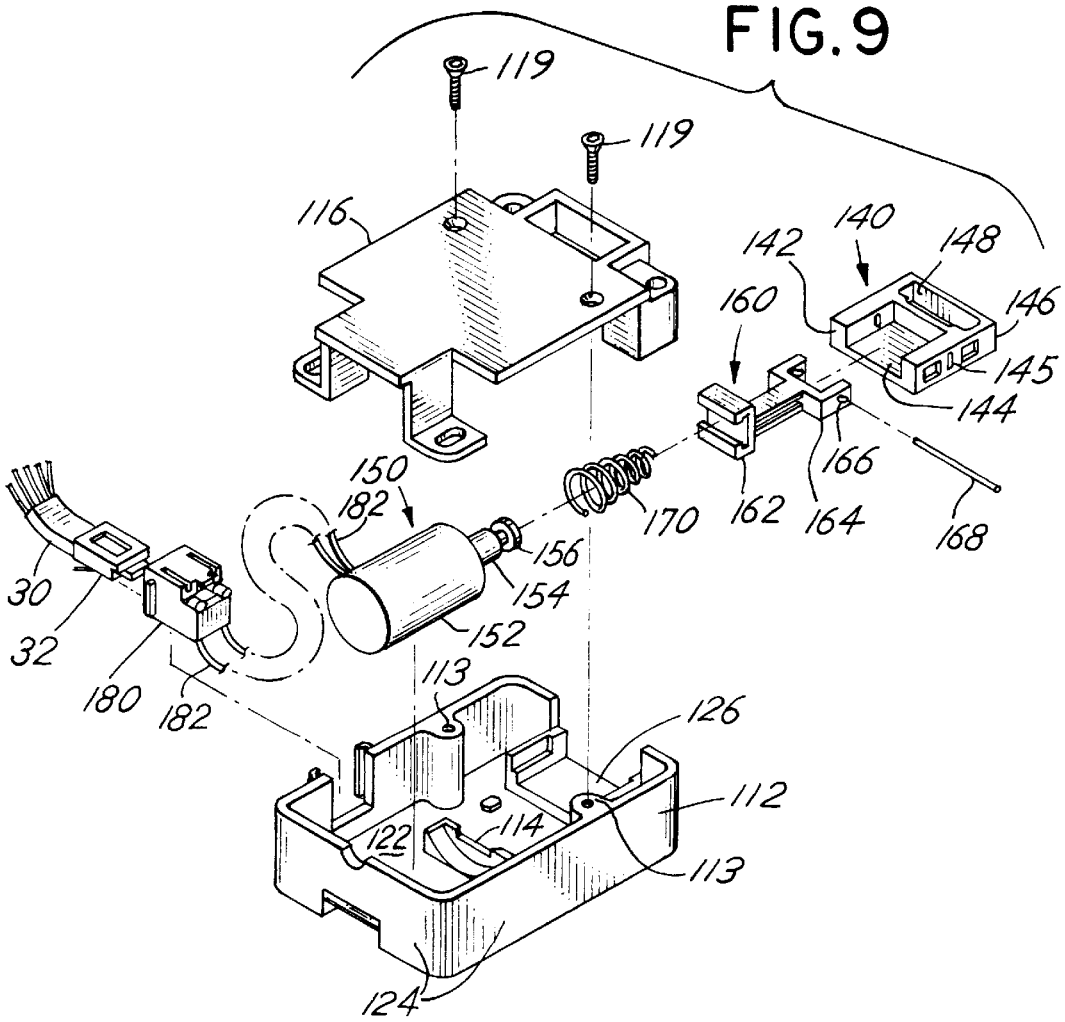
FIG. 9 is an exploded perspective view of the electronically controlled security lock depicted in FIGS. 1–8.

The electronically controlled security lock 100 of the present invention includes a housing 110 which is adapted to be mounted to the interior surface of door 12 by conventional fasteners (not shown) or by any other means known in the art. In the illustrated embodiment, the housing 110 includes a base portion 112 and a separate cover portion 116. As best shown in FIG. 9, these two housing segments 112 and 116 are united by a pair of bolts 119 which are received by bosses 113 formed in the base portion 112. The housing 110 also includes an interior region 122 where the components of the lock 100 are disposed, a plurality of exterior surfaces 124, and an aperture 126 therethrough. The housing 110 is preferably formed of a durable material such as high impact polystyrene, although other materials are certainly permissible.

As shown in FIG. 4, an actuator 150 such as an electromagnetic solenoid is arranged within the interior region 122 of the housing 110. As is customary in the art, the electromagnetic actuator 150 includes a coil (not shown), a surrounding casing 152, and a magnetic plunger element 154 which moves with respect to the casing 152 when an electric current is passed through the coil. In the illustrated embodiment, the casing 152 of the solenoid 150 is fixedly received by a retaining shoulder 114 formed in the base portion 112 of the housing 110, the plunger element 154 includes an annular tip portion 156, and the coil is operatively connected to a modular port 180 by a pair of wires 182. As best shown in FIG. 9, this modular port 180 is arranged in one of the exterior surfaces 124 of the housing 110 and is adapted to receive the jack end 32 of modular connector 30. In any event, when the correct access code is entered into the electronic input panel 20, the modular port 180 supplies electric current to the solenoid 150 which causes the plunger element 154 to move with respect to the casing 152.

Figure 7:
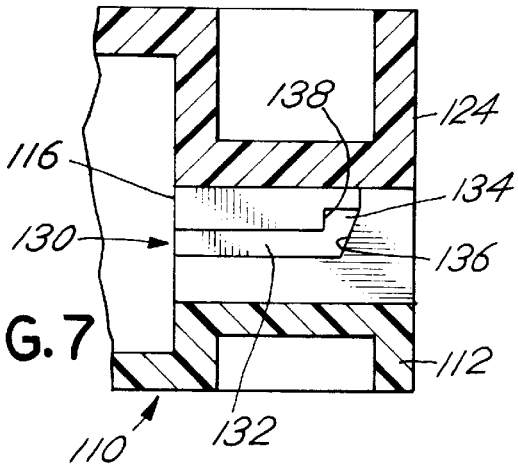
FIG. 7 is an enlarged, fragmentary, cross-sectional view of the electronically controlled security lock depicted in FIGS. 5–6B, with the dead bolt removed in order to show the generally L-shaped channel in greater detail.
Figure 8:
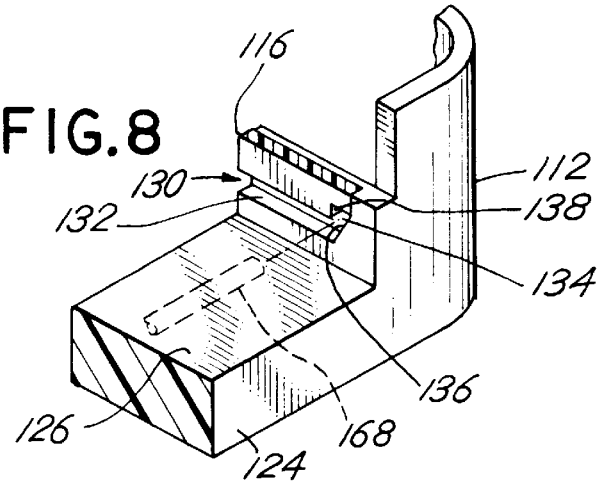
FIG. 8 is an enlarged, fragmentary, perspective view of the electronically controlled security lock, showing the aperture of the housing and the generally L-shaped channel in greater detail.

The inventive security lock 100 also includes a dead bolt 140 which is slidably disposed in the aperture 126 of the housing 110, and a linkage 160 which is connected to both the dead bolt 140 and to the annular tip portion 156 of the plunger element 154. Although other materials are certainly permissible, in the presently preferred embodiment of the lock 100, the linkage 160 is formed of nylon and the dead bolt 140 is formed of nylon with a 40% glass filling. As best shown in FIG. 9, the dead bolt 140 includes an inboard end 142 with a first cavity 144, an outboard end 146 with a second cavity 148, and a pair of opposed and generally openings 145 formed through the sides of the dead bolt 140 and into the first cavity 144. In the illustrated embodiment, the linkage 160 includes a slotted portion 162 which receives and retains the annular tip portion 156 of the plunger element 154. The linkage 160 also includes a yoke portion 164 which is received by the first cavity 144 of the dead bolt 140 and is connected to the dead bolt 140 via a pin 168. More specifically, the pin 168 of the linkage 160 is received by inclined cam slots 166 formed in the yoke portion 164 of the linkage 160, by the obround openings 145 of the dead bolt 140, and by a pair of opposed, aligned, and generally L-shaped channels 130 formed in the aperture 126 of the housing 110. As best shown in FIGS. 7 and 8, each channel 130 includes a relatively long first leg portion 132, and a relatively short second leg portion 134 with an inclined camming surface 136 and a stop 138. In the illustrated embodiment, each channel 130 is conveniently formed by neighboring segments of the base and cover portions 112 and 116 when these two portions 112 and 116 of the housing 110 are assembled together.

In operation, the plunger element 154 of the actuator 150 moves both the linkage 160 and the dead bolt 140 when an electric current is passed through the coil of the solenoid 150. In particular, the dead bolt 140 moves between extended and retracted positions relative to the exterior surface 124 of the housing 110. In the extended position, the outboard end 146 of the dead bolt 140 protrudes outwardly from the exterior surface 124 of the housing 110, as shown, for example, in FIGS. 2, 4, 5, and 6A. In the retracted position, conversely, the outboard end 146 of the dead bolt 140 is substantially flush with the exterior surface 124 of the housing 110 and the dead bolt 140 is substantially withdrawn within the interior region 122, as shown, for example, in FIGS. 3 and 6B. In any event, when the lock 100 is mounted to the safe door 12 and the dead bolt 140 is moved between the extended and retracted positions, the outboard end 146 of the dead bolt 140 is adapted to move into and out of engagement with a recess (not shown) formed within the safe 10. Of course, when the dead bolt 140 engages this recess, the door 12 is positionally locked with respect to the safe 10. In this way, unauthorized access to the contents of the safe 10 is conveniently prevented.

In the illustrated embodiment, a spring 170 is compressibly disposed between the casing 152 of the electromagnetic actuator 150 and the slotted portion 162 of the linkage 160 for biasing the dead bolt 140 towards the extended position when no electric current is supplied to the electromagnetic actuator 150. As best shown in FIGS. 4 and 9, this spring 170 is in the form of a coil spring and is arranged around the plunger element 154 of the electromagnetic actuator 150.

Figure 6A:
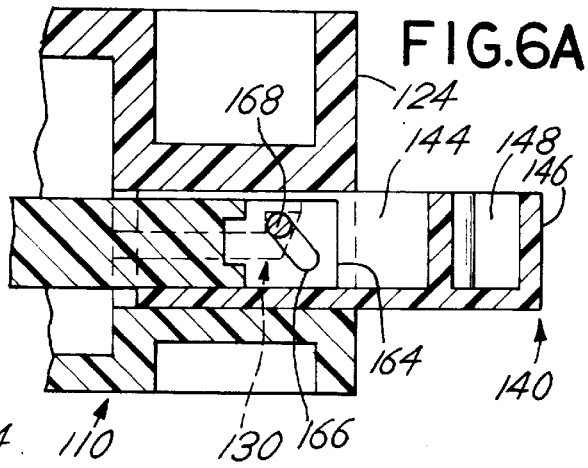
FIG. 6A is an enlarged, fragmentary, cross-sectional view of the electronically controlled security lock depicted in FIG. 5, showing a pin of the linkage engaging an inclined cam slot formed in the linkage and also engaging a stop of a generally L-shaped channel formed in the aperture of the housing while the dead bolt is in the extended position.
Figure 6B:
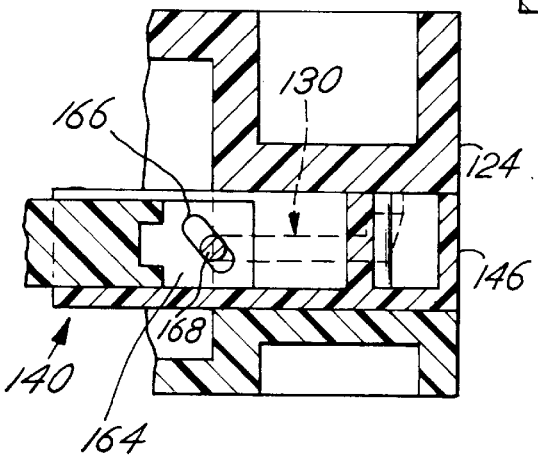
FIG. 6B is an enlarged, fragmentary, cross-sectional view of the electronically controlled security lock with the dead bolt in the retracted position and the pin of the linkage engaging the opposite end of the generally L-shaped channel.

As the dead bolt 140 moves between the retracted and extended positions, the pin 168 of the linkage 160 moves along the inclined cam slots 166 of the linkage 160, along the obround openings 145 of the dead bolt, and along the generally L-shaped channels 130 of the aperture 126. For example, when the dead bolt 140 is in the retracted position, the pin 168 of the linkage 160 is disposed towards the bottom of the obround openings 145 of the dead bolt 140, towards bottom of the inclined cam slots 166 of the linkage 160, and in the first legs 132 of the channels 130, as shown in FIG. 6B. When the dead bolt 140 is in the extended position, conversely, the pin 168 of the linkage 160 is disposed at the top of the obround openings 145 of the dead bolt 140, at the top of the inclined cam slots 166 of the linkage 160, and in the second legs 134 of the channels 130, as shown in FIG. 6A, where it engages the stops 138 of the channels 130.

In keeping with an important aspect of the present invention, the pin 168 of the linkage 160 interacts with the channels 130 in a manner which latches the dead bolt in the extended position and provides the inventive security lock 100 with a high degree of pick and tamper resistance. For example, when the dead bolt 140 is in the extended position, engagement between the pin 168 of the linkage 160 and the stops 138 of the channels 130 positionally retains or latches the dead bolt 140 in the extended position and makes it virtually impossible for a thief or a vandal to defeat the lock 100 by exerting an external prying force on the outboard end 146 of the dead bolt 140 or by applying an external jarring force to the lock 100 itself. When the dead bolt 140 is moved towards the retracted position by withdrawing the plunger element 154 of the solenoid 150, however, the pin 168 of the linkage 160 reliably cams off of the inclined camming surface 136 of the second leg portion 134 and into the first leg portion 132 where it is unobstructed by the stops 138.

In application, the electronically controlled security lock 100 of the present invention operates in the following manner. When the door 12 of the safe 10 is closed and the dead bolt 140 is received by the recess formed in the safe 10, the door 12 is positionally locked with respect to the safe 10 and the dead bolt 140 is latched in the extended position by engagement between the pin 168 of the linkage 160 and the stops 138 of the channels 130. When the correct access code is entered into the electronic input panel 20 by an authorized user, however, an electric current is supplied to the coil of the electromagnetic actuator 150 which causes the plunger element 154 to overcome the biasing provided by the spring 170, to withdraw within the casing 152, and to exert an inward pulling force on the linkage 160. This pulling force, in turn, causes the pin 168 of the linkage 160 to move downwardly along the obround openings 145 of the dead bolt 140, to move downwardly along the inclined cam slots 166 of the linkage 160, and to move downwardly along the inclined camming surfaces 136 until it disengages the stops 138 of the channels 130. Once the pin 168 is free from the stops 138 of the channel 130, it moves along the first leg 132 of the channel 130 without restraint while the dead bolt 140 moves towards the retracted position and out of engagement with the recess of the safe 10. Of course, once the dead bolt 140 is in the retracted position, the door 12 of the safe 10 may be opened since the dead bolt 140 is no longer received by the recess of the safe 10. To lock the safe 10, the door 12 is closed and the appropriate access code is entered into the electronic input panel 20 so as to deactivate the electric current supplied to the electromagnetic actuator 150. Once deactivated, the spring 170 moves the dead bolt 140 into the extended position where it engages the recess of the door 12.

While the present invention has been described and disclosed with an emphasis upon a preferred embodiment, it will be understood, of course, that the present invention is not strictly limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. An electronically controlled security lock comprising:

a housing having an interior region, exterior surfaces, and an aperture therein, the aperture including a pair of opposed channels, each channel having a stop;

a dead bolt slidably disposed within the aperture of the housing;

a reversible electric actuator arranged within the interior region of the housing, the actuator including a movable plunger element; and a linkage connecting the plunger element and the dead bolt, the linkage including a pin which is received by openings formed in the dead bolt and by the channels of the aperture, the plunger element moving the linkage and the dead bolt when an electric current is passed through the actuator, the dead bolt moving between a retracted position wherein the dead bolt is substantially withdrawn within the housing and an extended position wherein the dead bolt protrudes at least partially outwardly away from the housing, the pin of the linkage engaging the stops of the channels when the dead bolt is in the extended position to latch the dead bolt in the extended position.

2. The electronically controlled security lock set forth in claim 1, further comprising:

a spring compressibly disposed between the actuator and the linkage for biasing the dead bolt towards the extended position.

3. The electronically controlled security lock set forth in claim 1, further comprising:

a modular port arranged in one of the exterior surfaces of the housing and operatively connected to the actuator, the modular port adapted to receive a modular connector.

4. The electronically controlled security lock set forth in claim 1, wherein the linkage includes at least one inclined cam slot.

5. The electronically controlled security lock set forth in claim 4, wherein the pin is also received by said at least one inclined cam slot of the linkage.

6. The electronically controlled security lock set forth in claim 5, wherein movement of the dead bolt between the retracted and extended positions causes the pin to move along said at least one inclined cam slot of the linkage, within the openings of the dead bolt, and along the channels of the aperture.

7. The electronically controlled security lock set forth in claim 5, wherein movement of the dead bolt away from the extended position causes the pin to move along said at least one inclined cam slot of the linkage, within the openings of the dead bolt, and away from the stops of the channels.

8. The electronically controlled security lock set forth in claim 1, wherein the linkage includes a yoke portion having a pair of inclined cam slots.

9. The electronically controlled security lock set forth in claim 8, wherein the pin is also received by the inclined cam slots of the yoke portions.

10. The electronically controlled security lock set forth in claim 9, wherein movement of the dead bolt between the retracted and extended positions causes the pin to move along the inclined cam slots of the yoke portion, within the openings of the dead bolt, and along the channels of the aperture.

11. The electronically controlled security lock set forth in claim 9, wherein movement of the dead bolt away from the extended position causes the pin to move along the inclined cam slots of the yoke portion, within the openings of the dead bolt, and away from the stops of the channels.

12. The electronically controlled security lock set forth in claim 1, wherein the channels of the aperture are generally L-shaped.

13. The electronically controlled security lock set forth in claim 12, wherein the generally L-shaped channels of the aperture include inclined camming surfaces.

14. The electronically controlled security lock set forth in claim 1, wherein the actuator comprises a solenoid.

15. An electronically controlled security lock comprising:

a housing having an interior region, exterior surfaces, and an aperture therein, the aperture including a pair of opposed generally L-shaped channels, each channel having a stop at one end thereof;

a dead bolt slidably disposed within the aperture of the housing, the dead bolt having at least one opening formed therein;

an electromagnetic actuator fixedly disposed within the interior region of the housing, the electromagnetic actuator including a plunger element which moves when the electromagnetic actuator is electrically energized;

a linkage connecting the plunger element and the dead bolt, the linkage including a yoke portion with a pair of inclined cam slots and a pin which is received by the inclined cam slots of the yoke portion, by said at least one opening of the dead bolt, and by the channels of the aperture, the plunger element moving the linkage and the dead bolt between a retracted position wherein the dead bolt is substantially flush with an exterior surface of the housing and an extended position wherein the dead bolt protrudes past one of the exterior surfaces of the housing, the pin of the linkage engaging the stops of the channels when the dead bolt is in the extended position to latch the dead bolt in the extended position; and a spring compressibly disposed between the electromagnetic actuator and the linkage for biasing the dead bolt towards the extended position.

16. The electronically controlled security lock set forth in claim 15, further comprising:

a modular port arranged in one of the exterior surfaces of the housing and operatively connected to the electromagnetic actuator, the modular port adapted to receive a modular connector.

17. The electronically controlled security lock set forth in claim 15, wherein movement of the dead bolt between the retracted and extended positions causes the pin to move along the inclined cam slots of the yoke portion, within the openings of the dead bolt, and along the channels of the aperture.

18. The electronically controlled security lock set forth in claim 15, wherein movement of the dead bolt away from the extended position causes the pin to move along the inclined cam slots of the yoke portion, within said at least one opening of the dead bolt, and away from the stops of the channels.

19. The electronically controlled security lock set forth in claim 15, wherein the housing and the dead bolt are formed of plastic.

20. A security lock comprising:

a housing having an interior region and an aperture therein, the aperture including at least one channel, said at least one channel including a stop;

a dead bolt slidably disposed within the aperture of the housing;

an actuator arranged within the interior region of the housing, the actuator including a plunger element movable in a direction generally parallel to the dead bolt direction of movement; and a linkage connecting the plunger element of the actuator and the dead bolt, the linkage including a pin which is received by at least one opening formed in the dead bolt and by said at least one channel of the aperture, the plunger element moving the linkage and the dead bolt between retracted and extended positions when the actuator is activated, the pin of the linkage engaging the stop of said at least one channel when the dead bolt is in the extended position to positionally retain the dead bolt in the extended position.

* * * * *